US012285701B1

(12) United States Patent
Juchniewicz

(10) Patent No.: US 12,285,701 B1
(45) Date of Patent: Apr. 29, 2025

(54) RANDOMLY DEFLATABLE BALLOON WITH BALL CHECK VALVE ACTION FOR SOLITARY ENJOYMENT AND GROUP PLAY

(71) Applicant: Bruce Arthur Juchniewicz, Chester, NH (US)

(72) Inventor: Bruce Arthur Juchniewicz, Chester, NH (US)

( * ) Notice: Subject to any disclaimer, the term of this patent is extended or adjusted under 35 U.S.C. 154(b) by 0 days.

(21) Appl. No.: 18/098,643

(22) Filed: Jan. 18, 2023

(51) Int. Cl.
*A63H 27/10* (2006.01)
*A63B 67/00* (2006.01)

(52) U.S. Cl.
CPC ..... *A63H 27/10* (2013.01); *A63B 67/002* (2013.01); *A63H 2027/1083* (2013.01)

(58) Field of Classification Search
CPC ... B65D 39/16; A63F 2009/0083–0084; A63F 2009/0086; A63B 67/002; A63B 41/04; A63B 2041/005; A63B 43/04; A63H 27/10; A63H 2027/1083; A63H 2027/1091
USPC ..... 473/577, 593, 594, 609, 610; 446/220, 446/224
See application file for complete search history.

(56) References Cited

U.S. PATENT DOCUMENTS

| | | | | |
|---|---|---|---|---|
| 1,300,640 | A | 4/1919 | Pasternak | |
| 1,447,848 | A | 3/1923 | Holycross | |
| 1,471,886 | A | 10/1923 | Micholl | |
| 1,629,838 | A * | 5/1927 | Perdue | A63H 27/10 446/224 |
| 1,745,576 | A | 2/1930 | Kempien | |
| 2,505,526 | A | 4/1950 | Louis | |
| 2,540,403 | A | 2/1951 | Myers | |
| 2,617,624 | A | 11/1952 | Jackson | |
| 2,625,770 | A | 1/1953 | James | |
| 2,635,387 | A | 4/1953 | Anderson | |
| 2,996,834 | A | 8/1961 | Maurice | |

(Continued)

FOREIGN PATENT DOCUMENTS

| | | | | |
|---|---|---|---|---|
| CN | 2055058 | U | 3/1990 | |
| JP | H1199286 | A | 4/1999 | |
| KR | 200198660 | Y1 * | 10/2000 | A63H 27/10 |

OTHER PUBLICATIONS

English machine translation of KR 200198660 Y1 (Bark) (Year: 2000).*
Qualatex 11" Assorted Standard Latex Balloons, https://www.amazon.com/Pioneer-Balloon-Company-Standard-Assorted/dp/B001IWOUL4, first available Oct. 21, 2008 (Year: 2008).*

(Continued)

*Primary Examiner* — Joseph B Baldori
(74) *Attorney, Agent, or Firm* — Russ Weinzimmer & Associates, PC; Russ Weinzimmer

(57) ABSTRACT

A randomly deflatable balloon having a nozzle, and an insertable lightweight ball that can become lodged in the nozzle, thereby forming a ball check valve. The lightweight ball is preferably made from expanded polystyrene foam. The balloon is inflated after the ball is inserted into the balloon. When the nozzle is released to allow air to escape from the balloon, the ball eventually gets trapped in the nozzle of the balloon, thereby blocking the outflow of air. The ball can be dislodged from the nozzle by tapping the balloon, which causes the balloon to rocket through the air until the ball gets trapped again in the nozzle, whereupon the balloon stops moving due to escaping air, and then drops to the ground, partially deflated. This can be repeated until the balloon is completely deflated. The random partial deflation can be the basis of both solitary and multiplayer games.

4 Claims, 3 Drawing Sheets

(56) References Cited

U.S. PATENT DOCUMENTS

| | | | | |
|---|---|---|---|---|
| 4,808,141 | A | 2/1989 | Runge | |
| 4,848,773 | A | 7/1989 | Lovik | |
| 4,878,335 | A | 11/1989 | Hardy | |
| 4,881,733 | A | 11/1989 | Rehkemper | |
| 5,088,267 | A | 2/1992 | Gee | |
| 5,135,222 | A | 8/1992 | Spector | |
| 6,048,591 | A | 4/2000 | Zwiebel | |
| 6,334,804 | B1 | 1/2002 | Brown | |
| 6,866,813 | B1 | 3/2005 | Trubitt | |
| 2008/0064542 | A1 | 3/2008 | Spector | |
| 2009/0318054 | A1 | 12/2009 | Wong | |
| 2014/0212074 | A1* | 7/2014 | Durst | A63H 27/10 383/44 |
| 2018/0104545 | A1 | 4/2018 | Burke | |

OTHER PUBLICATIONS

Shaley Howard, "Oh for the Love of Dog. Seriously People?", https://adventuresofabutchdogwalker.com/home/2019/2/11/oh-for-the-love-of-dog, Feb. 12, 2019 (Year: 2019).*

Author: Plantsarelife Title: Frozen toy inside of a balloon rumble me WEBSITE: https://rumble.com/vduzqn-frozen-toy-inside-of-a-balloon-rumble-me.html DATE: Page Downloaded Sep. 14, 2022 Google Result #1.

Title: 3D Beach Ball with clown Fish inside WEBSITE: https://www.aliexpress.com/item/30cm-3D-Beach-Ball-with-Clownfish-inside DATE: Page Downloaded Sep. 14, 2022 Google Result #2.

Author: Mbfloyd Title: Ball in Dog - Balloon Animal Lessons #63 WEBSITE: https://www.youtube.com/watch?v=c3oaOsRKU-0 DATE: Apr. 14, 2014 Youtube Result #1.

* cited by examiner

RANDOMLY DEFLATABLE BALLOON WITH BALL CHECK VALVE ACTION FOR SOLITARY ENJOYMENT AND GROUP PLAY

FIELD OF THE INVENTION

The present invention relates to toys, and more particularly to inflatable toys.

BACKGROUND OF THE INVENTION

Inflatable toys have long been a popular pastime for children and adults. Party balloons have been enjoyed for many years, either inflated by mouth, or inflated using pressurized air or helium from a tank. Each inflated balloon is then sealed off with a knot, or with a clip that seals off the nozzle of the balloon, for example. Such sealed balloons are amusing for a period of time until they become deflated, due to air or helium diffusing out through the wall of the balloon, and/or leaking through small passages in the knot, even when the knot is tied tightly.

When the balloon becomes deflated, the balloon is typically disposed of in the trash, rather than untying the knot to re-inflate the balloon, which can be difficult and/or time-consuming. Thus, such party balloons are only single-use items, which is wasteful, and can be harmful to the environment.

SUMMARY OF THE INVENTION

The randomly deflatable balloon of the invention includes a lightweight ball trapped inside the balloon that intermittently cooperates with the nozzle of the balloon to function as a ball check valve that permits air to sporadically escape from the balloon. The randomly deflatable balloon can be used for both solitary enjoyment and for group play.

Since the randomly deflatable balloon can be re-used after each deflation, it can be used many times for amusement before being discarded, thereby being economical and protecting the environment.

The random nature of the ball check valve action of the lightweight ball interacting with the nozzle of the balloon results in the ball being able to prevent air from escaping from the balloon until the balloon is tapped or hit, whereupon the ball is dislodged from the nozzle of the balloon, thereby allowing the air in the balloon to escape. The escaping air causes the balloon to move in unpredictable and amusing ways, until the ball is pushed back into the nozzle by the rush of air flowing into and then out from the nozzle of the balloon.

The random nature of the ball check valve action of the lightweight ball interacting with the nozzle of the balloon can be amusing by itself, and can also be the basis for many games. These games include a multi-player game where players take turns hitting the randomly deflatable balloon back and forth using hands or using a racket or a bat, until the randomly deflatable balloon is completely deflated; and a single-player game where one taps the randomly deflatable balloon upwards, counting the number of times the player can tap the randomly deflatable balloon until it deflates completely.

A general aspect of the invention is a randomly deflatable balloon that includes: a latex balloon having a nozzle section and an inflatable section in fluid communication with the nozzle section; and an expanded polystyrene foam ball placed within the inflatable section, the expanded polystyrene foam ball configured to move into and temporarily seal off the nozzle section after inflation of the latex balloon, and configured to randomly seal off the nozzle section during deflation of the latex balloon.

In some embodiments, the latex balloon is an 11 inch standard latex balloon.

In some embodiments, the latex balloon is 12×7×2 inches.

In some embodiments, the expanded polystyrene foam ball is 1.2 inches in diameter.

In some embodiments, the expanded polystyrene foam ball is 1.18 inches in diameter.

In some embodiments, the expanded polystyrene foam ball is 0.988 ounces in weight.

In some embodiments, the expanded polystyrene foam ball is white.

In some embodiments, the nozzle section together with the expanded polystyrene foam ball operate as a ball check valve.

Another general aspect of the invention is a method for playing a multi-player game using a randomly deflatable balloon including a latex balloon having a nozzle section and an inflatable section in fluid communication with the nozzle section, and having an expanded polystyrene foam ball within the inflatable section. The method includes: a first player inflating the randomly deflatable balloon to an inflated state such that the randomly deflatable balloon cannot deflate due to the expanded polystyrene foam ball becoming lodged in the nozzle section; the first player hitting the randomly deflatable balloon in the inflated state so as to launch the randomly deflatable balloon towards a second player; the second player hitting the randomly deflatable balloon back to the first player, while also attempting to avoid dislodging the expanded polystyrene foam ball from the nozzle section, thereby preventing the randomly deflatable balloon from deflating or further deflating; and the first and second players hitting the randomly deflatable balloon back and forth until the randomly deflatable balloon is completely deflated, a winning player being determined by being a player that successfully hits the randomly deflatable balloon a last time to another player.

Yet another general aspect of the invention is a method for playing a single-player game using a randomly deflatable balloon including a latex balloon having a nozzle section and an inflatable section in fluid communication with the nozzle section, and having an expanded polystyrene foam ball within the inflatable section. This method includes: a solitary player inflating the randomly deflatable balloon to an inflated state, such that the randomly deflatable balloon cannot deflate due to the expanded polystyrene foam ball becoming lodged in the nozzle section; the solitary player hitting the randomly deflatable balloon so as to launch the randomly deflatable balloon in the inflated state, and watching it land in a partially deflated state; the solitary player lifting the randomly deflatable balloon in the partially deflated state and hitting the randomly deflatable balloon again, attempting to also avoid dislodging the expanded polystyrene foam ball from the nozzle section, thereby preventing the randomly deflatable balloon from deflating; and the solitary player hitting the randomly deflatable balloon as many times as possible until the randomly deflatable balloon is completely deflated, the solitary player counting the number of times he/she was able to lift and hit the randomly deflatable balloon BEFORE the randomly deflatable balloon became completely deflated, thereby creating a first hit count, and playing again so as to create a second hit count that exceeds the first hit count.

BRIEF DESCRIPTION OF THE DRAWINGS

Many additional features and advantages will become apparent to those skilled in the art upon reading the following description, when considered in conjunction with the accompanying drawings, wherein.

DETAILED DESCRIPTION

Figure 1:
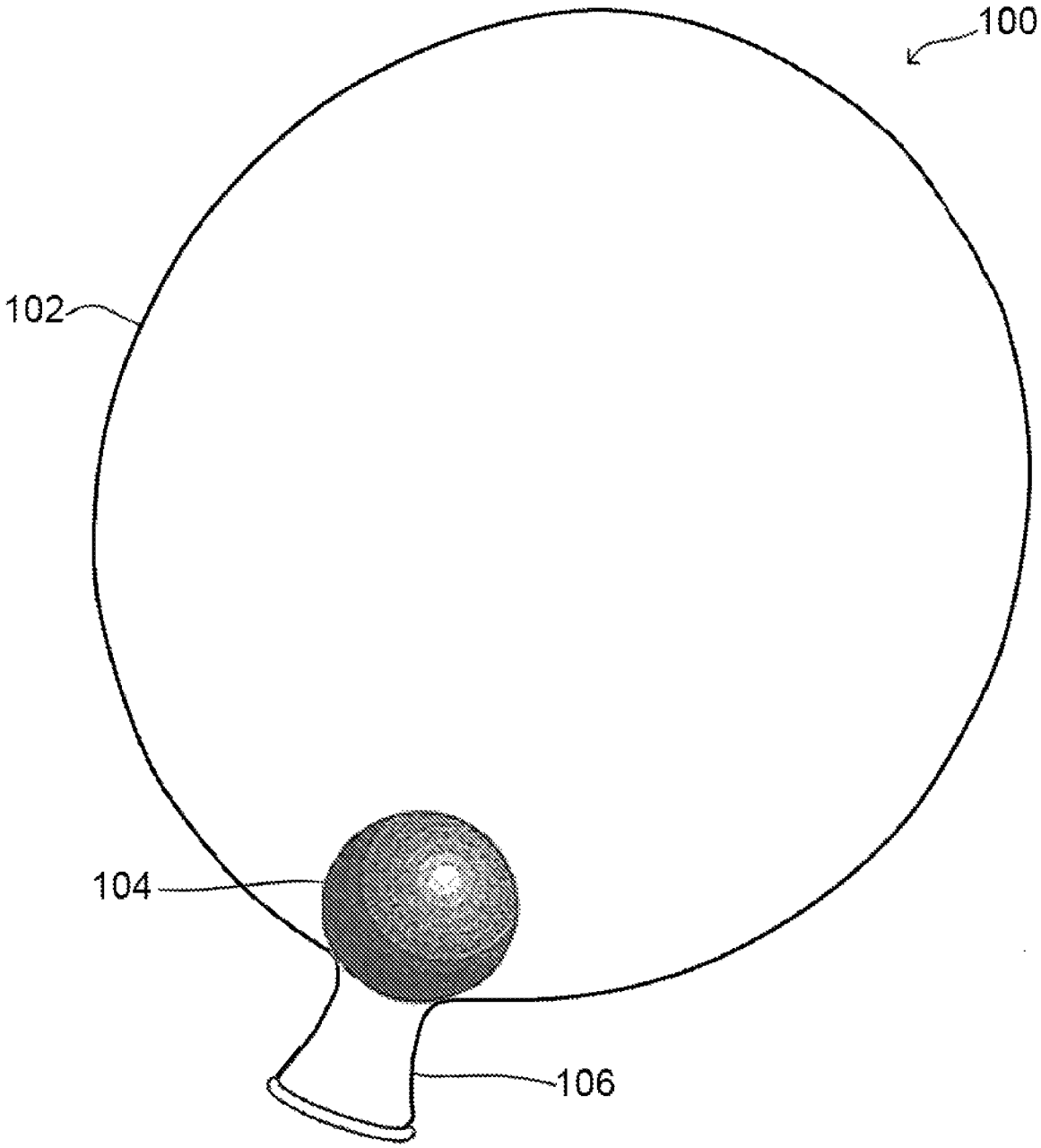
FIG. 1 is a cross sectional view of an embodiment of the randomly deflatable balloon in an inflated state, showing a lightweight ball within the balloon, the lightweight ball working together with the nozzle of the balloon to function as a ball check valve.

Referring to FIG. 1, an embodiment of the randomly deflatable balloon 100 is shown. A latex balloon 102 has a polystyrene foam ball 104 that has been inserted through the nozzle 106 of the balloon 102. The polystyrene foam ball 104 cooperates with the nozzle 106 to function as a ball check valve. When the latex 102 is inflated, the polystyrene foam ball 104 moves away from the nozzle 106, thereby allowing air to flow in and inflate the balloon 102.

During deflation, the polystyrene foam ball 104 is drawn towards and pressed against the nozzle 106 by the pressure of outward flowing air so as to seal the nozzle 106, thereby preventing the latex balloon 102 from deflating. Because the sealing action is temporary, the polystyrene foam ball 104 can be dislodged with a squeeze, a tap, or another application of external force upon the latex balloon 102.

The ball 104 that works with the nozzle 106 to function as a ball check valve can also be made from hollow plastic, or other lightweight material. The ball 104 can be of 1 inch diameter, or can be larger or smaller so as to be able to cooperate with the nozzle 106 of the latex balloon 102 so as to function as a ball check valve. The latex balloon 102 can be made in various sizes, such as an 11 inch standard latex balloon.

Figure 2:
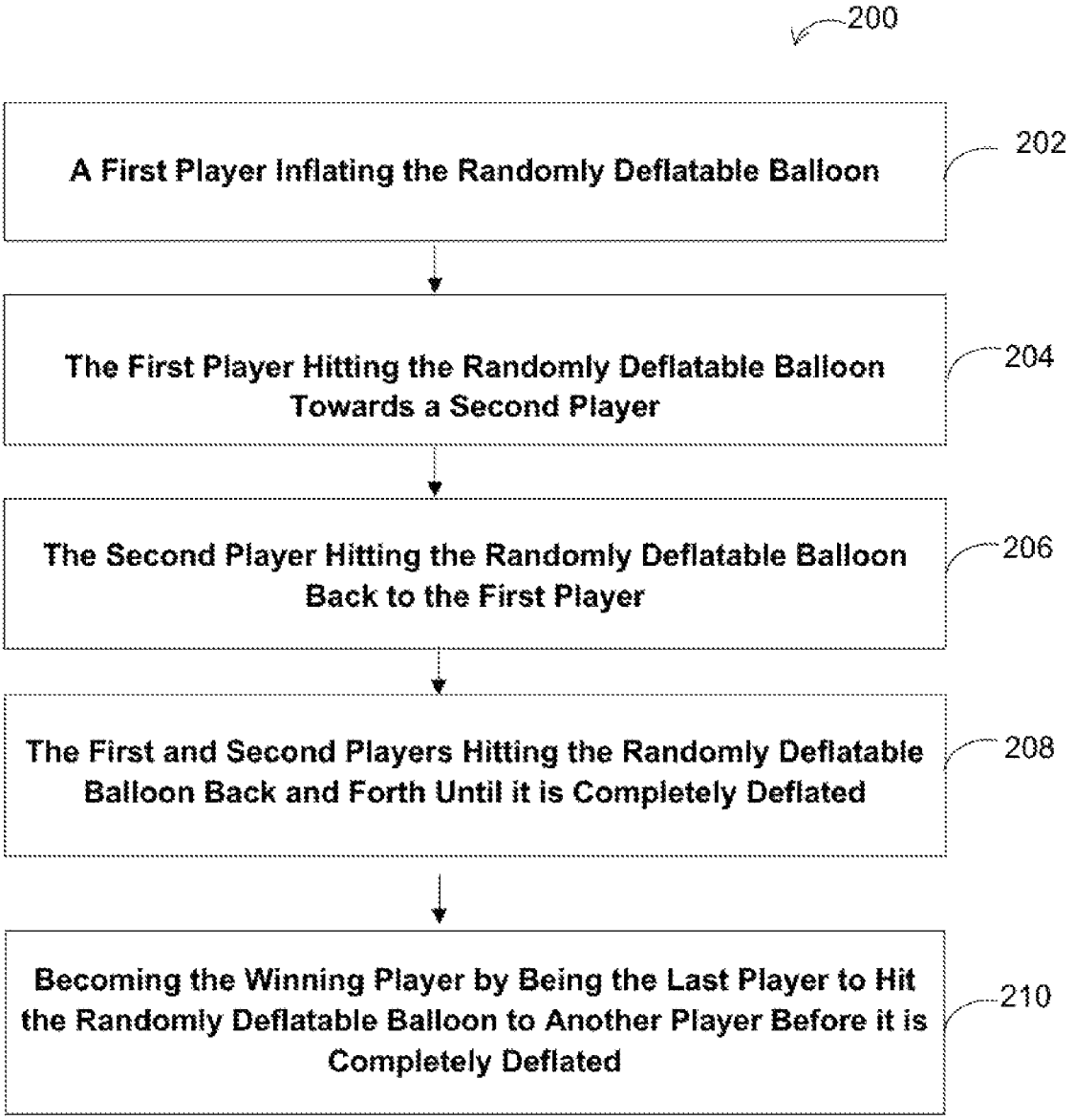
FIG. 2 is a flow chart of a multi-player game method using the randomly deflatable balloon of FIG. 1.

Referring to FIG. 2, a multi-player game method 200 for using the randomly deflatable balloon 100 is shown. The first step of the method 200 includes a first player inflating 202 the balloon 100, using their mouth, a pump, or a pressurized air canister, for example.

Next, first player hits 204 the inflated balloon 100 so as to launch the randomly deflatable balloon 100 towards a second player, using a hand, a paddle, or a racquet, for example.

Then, the second player hits 206 the randomly deflatable balloon 100 back to the first player, while also attempting to avoid dislodging the expanded polystyrene foam ball 104 from the nozzle section 106, thereby preventing the randomly deflatable balloon 100 from deflating or further deflating.

Next, the first and second players hit 208 the randomly deflatable balloon 100 back and forth until the randomly deflatable balloon 100 is completely deflated.

The winning player is determined 210 by being the last player to successfully hit the randomly deflatable balloon 100 in a partially inflated state to the other player. Once the balloon 100 is completely deflated, gameplay stops.

Figure 3:
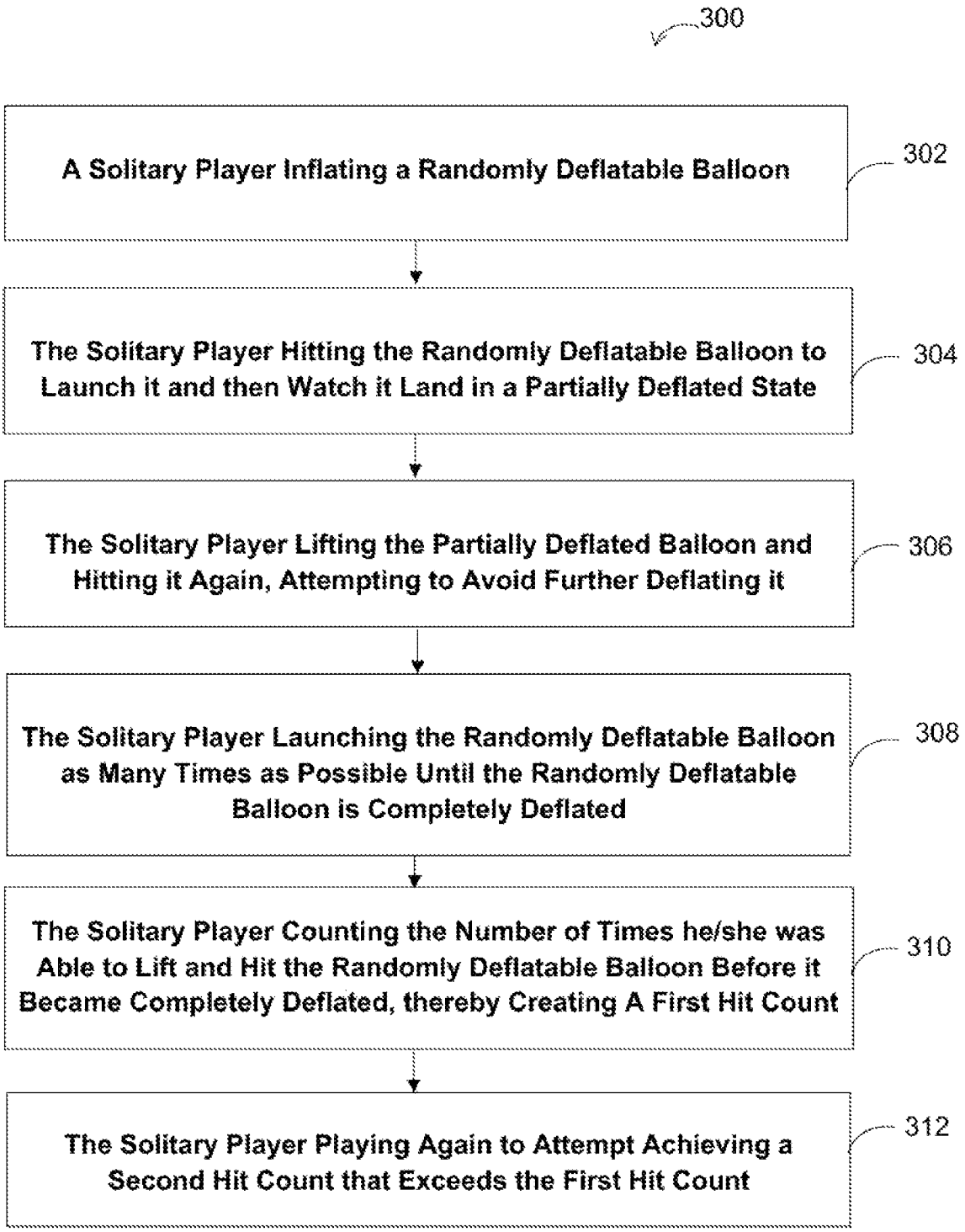
FIG. 3 is a flow chart of solitary game method using the randomly deflatable balloon of FIG. 1.

With reference to FIG. 3, a single player game method 300 for using the randomly deflatable balloon 100 is shown. First, a solitary player inflates 302 the randomly deflatable balloon 100 to an inflated state, such that the randomly deflatable balloon 100 cannot deflate due to the expanded polystyrene foam ball 104 becoming lodged in the nozzle section 106.

Next, the solitary player hits 304 the randomly deflatable balloon 100 so as to launch the randomly deflatable balloon 100 in the inflated state, and watching it land in a partially deflated state.

Then, the solitary player lifts the randomly deflatable balloon in the partially deflated state and hits 306 the randomly deflatable balloon 100 again, attempting to also avoid dislodging the expanded polystyrene foam ball 104 from the nozzle section. 106, thereby preventing the randomly deflatable balloon 100 from deflating.

Next, the solitary player hits 308 the randomly deflatable balloon as many times as possible until the randomly deflatable balloon 100 is completely deflated.

While the solitary player hits 308 the randomly deflatable balloon as many times as possible, the solitary player counts 310 the number of times he/she was able to lift and hit the randomly deflatable balloon 100 before the randomly deflatable balloon 100 became completely deflated, thereby creating a first hit count.

The solitary player plays again 312, hitting 308 the randomly deflatable balloon as many times as possible until the randomly deflatable balloon 100 becomes completely deflated, attempting to create a second hit count that exceeds the first hit count.

Other modifications and implementations will occur to those skilled in the art without departing from the spirit and the scope of the invention as claimed. Accordingly, the above description is not intended to limit the invention, except as indicated in the following claims.

What is claimed is:

1. A method for playing a multi-player game using a randomly deflatable balloon including a latex balloon having a nozzle section and an inflatable section in fluid communication with the nozzle section, and having an expanded polystyrene foam ball within the inflatable section, the method comprising:

a first player inflating the randomly deflatable balloon having an expanded polystyrene foam ball within the inflatable section to an inflated state such that the randomly deflatable balloon cannot deflate due to the expanded polystyrene foam ball becoming lodged in the nozzle section of the randomly deflatable balloon;

the first player hitting the randomly deflatable balloon in the inflated state so as to launch the randomly deflatable balloon towards a second player, while also attempting to avoid dislodging the expanded polystyrene foam ball from the nozzle section, thereby minimizing deflating or further deflating of the randomly deflatable balloon, resulting in random partial deflation of the balloon;

the second player hitting the randomly deflatable balloon back to the first player, while also attempting to avoid dislodging the expanded polystyrene foam ball from the nozzle section, thereby minimizing deflating or further deflating of the randomly deflatable balloon, resulting in random partial deflation of the balloon; and the first and second players hitting the randomly deflatable balloon back and forth until the randomly deflatable balloon is completely deflated due to the random partial deflation of the balloon, thereby ending the game.

2. The method of claim 1, further comprising:

determining the winning player as being the last player that successfully hits the randomly deflatable balloon in a partially inflated state to the other player.

3. A method for playing a single-player game using a randomly deflatable balloon including a latex balloon having a nozzle section and an inflatable section in fluid communication with the nozzle section, and having an expanded polystyrene foam ball within the inflatable section, the method comprising:

a solitary player inflating the randomly deflatable balloon to an inflated state, such that the randomly deflatable balloon cannot deflate due to the expanded polystyrene foam ball becoming lodged in the nozzle section;

the solitary player hitting the randomly deflatable balloon so as to launch the randomly deflatable balloon in the inflated state, and watching it land in a partially deflated state; and the solitary player lifting the randomly deflatable balloon in the partially deflated state and hitting the randomly deflatable balloon again, attempting to also avoid dislodging the expanded polystyrene foam ball from the nozzle section, thereby minimizing partial-deflating of the randomly deflatable balloon; and the solitary player hitting the randomly deflatable balloon as many times as possible until the randomly deflatable balloon is completely deflated.

4. The method of claim 3, further comprising:

the solitary player counting the number of times he/she was able to lift and hit the randomly deflatable balloon BEFORE the randomly deflatable balloon became completely deflated due to repeated partial deflations, thereby creating a first hit count, and playing again so as to create a second hit count that exceeds the first hit count.

* * * * *